US005888417A

United States Patent [19]

Akioka et al.

[11] Patent Number: 5,888,417

[45] **Date of Patent: *Mar. 30, 1999**

[54] RARE EARTH BONDED MAGNET AND COMPOSITION THEREFOR

[75] Inventors: Koji Akioka; Hayato Shirai; Ken Ikuma, all of Suwa, Japan

[73] Assignee: Seiko Epson Corporation, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 732,967

[22] Filed: Oct. 16, 1996

[30] Foreign Application Priority Data

Oct. 18, 1995 [JP] Japan ..... 7-270401
Nov. 9, 1995 [JP] Japan ..... 7-291487

[51] Int. Cl.[6] ..... H01F 1/08; H01F 1/055; H01F 1/057; H01F 1/059

[52] U.S. Cl. ..... 252/62.55; 252/62.54; 148/301; 148/302

[58] Field of Search ..... 252/62.54, 62.55, 252/62.58, 62.57; 148/301, 302

[56] References Cited

U.S. PATENT DOCUMENTS

| | | | |
|---|---|---|---|
| 2,689,398 | 9/1954 | Gaut et al. | 252/62.54 |
| 4,402,770 | 9/1983 | Koon | 148/31.51 |
| 4,462,919 | 7/1984 | Saito et al. | 252/62.54 |
| 4,497,722 | 2/1985 | Tsuchida et al. | 252/62.54 |
| 4,792,367 | 12/1988 | Lee | 148/104 |
| 4,844,754 | 7/1989 | Lee | 148/302 |
| 4,851,058 | 7/1989 | Croat | 148/302 |
| 4,921,551 | 5/1990 | Vernia et al. | 148/101 |
| 4,988,755 | 1/1991 | Dickens et al. | 252/62.54 |
| 5,062,981 | 11/1991 | Nomura et al. | 252/62.54 |
| 5,376,291 | 12/1994 | Watanabe | 252/62.54 |
| 5,545,266 | 8/1996 | Hirosawa et al. | 252/62.54 |

FOREIGN PATENT DOCUMENTS

| | | |
|---|---|---|
| A-59-136909 | 4/1984 | Japan . |
| 59/130108 | 1/1986 | Japan . |
| A-62-208608 | 9/1987 | Japan . |
| A-01-011304 | 5/1989 | Japan . |
| A-02-065103 | 5/1990 | Japan . |
| 4-324914 | 11/1992 | Japan . |
| 5-6323 | 1/1993 | Japan . |
| 53-04013 | 11/1993 | Japan . |
| A-05-304013 | 11/1993 | Japan . |

OTHER PUBLICATIONS

"Cobalt–Free and Samarium–Free Permanent Magnet Materials Based on an Iron–Rare Earth Boride", H.H. Stadelmaier, N.A. Elmasry, and S. Cheng, *Materials Letters*, vol. 2, No.2, Oct. 1983.

(List continued on next page.)

*Primary Examiner*—Melissa Bonner
*Attorney, Agent, or Firm*—Harness, Dickey & Pierce, P.L.C.

[57] ABSTRACT

A rare earth bonded magnet formed by bonding a rare earth magnet powder with a binding resin contains the rare earth magnet powder, and a thermoplastic resin serving as the binding resin in an amount within a range of from 1 to 5 wt. %, and preferably further contains an oxidation inhibitor. As the rare earth magnet powder, for example, at least one of an Sm—Co alloy, an R—Fe—B alloy (where, R represents at least a kind of rare earth elements including Y) and an Sm—Fe—N alloy can be appropriately used. As the thermoplastic resin, for example, polyamide, a liquid crystal polymer, or a PPS is appropriately employed. As the oxidation inhibitor, a chelating agent is appropriately applicable. In such a rare earth bonded magnet, the thermoplastic resin covers the outer surface of the rare earth magnet powder 2, and is present so as to prevent particles of the magnet powder from coming into contact with each other. Such a rare earth bonded magnet should preferably have a void ratio of no more than 2 vol. %.

16 Claims, 1 Drawing Sheet

OTHER PUBLICATIONS

"Composition Dependence of the Coercive Force and Microstructure of Crystallized Amorphous $(Fe_xB_{1-x})_{0.9}Tb_{0.05}La_{0.05}$ Alloys", N.C.Koon, B.N.Das, and J.A. Geohegan, *IEEE Transactions on Magnetics*, vol. MAG–18, No. 6, Nov. 1982.

"Hot–Pressed Neodymium–Iron–Boron Magnets", R.W.Lee, *Appl. Phys. Lett.*, vol. 46, No. 8, Apr. 1985.

"Magnetic Properties of Rare–Earth–Iron Intermetallic Compounds", K. Strnat, G. Hoffer, and A.E.Ray, *IEEE Transactions on Magnetics*, vol. MAG–2, No. 3, Sep. 1966.

"New Material for Permanent Magnets on a Base of Nd and Fe", M.Sagawa, S. Fujimura, N. Togawa, H. Yamamoto, and Y. Matsuura, *J. Appl. Phys.* vol. 55, No. 6, American Insitute of Physics, Mar., 1984.

"The Metallurgy of the Iron–Neodymium–Boron Permanent Magnet System", H.H.Stadelmaier, N.A.Elmasry, N.C. Liu, and S.F.Cheng, *Materials Letters*, vol. 2, No. 5A, Jun. 1984.

"Thermal and Magnetic Properties of Amorphous $Pr_x(Fe_{0.8}B_{0.2})_{1-x}$", L. Kabacoff, S. Dallek, C. Modzelewski, and W. Krull, *J. Appl. Phys.* vol. 53, No. 3, Mar, 1982.

RARE EARTH BONDED MAGNET AND COMPOSITION THEREFOR

BACKGROUND OF THE INVENTION

1. Field of the Invention

The present invention relates to a rare earth bonded magnet molded by bonding a rare earth magnet powder with a bonding resin (binder) and a composition of a rare earth bonded magnet to manufacture the same.

2. Description of the Prior Art

A rare earth bonded magnet is manufactured by using a mixture (compound) of a rare earth magnet powder and a binding resin (binder), and molding the mixture under pressure into a desired shape. Commonly employed molding methods include the compaction molding method, the injection molding method and the extrusion method.

The compaction molding method comprises the steps of packing the compound into a pressing die, compacting the packing with pressure to obtain a molded body, and then heating the molded body for setting the thermosetting resin used as the binding resin, thereby manufacturing a magnet. As compared with the other methods, this method permits molding with a smaller amount of binding resin. The resultant magnet contains a smaller amount of resin, and this is advantageous in enhancing magnetic properties. This method suffers, however a low degree of versatility with respect to the magnet shape and a low productivity.

The injection molding method comprises the steps of heating the compound to melt the thermoplastic resin of the compound, injecting the resultant melt into a mold while the melt has a sufficient fluidity, and molding the melt into a prescribed shape of magnet. This method is advantageous in that a high degree of versatility with respect to the shape of magnet is available, permitting easy manufacture of even of irregular shaped magnets. However, because a high level of fluidity of the melt is required during molding, it is necessary to increase the amount of binding resin, leading to a drawback of poor magnetic properties of the resultant magnet.

The extrusion molding method comprises the steps of heating the compound bed into an extruder to melt the thermoplastic resin of the compound, extruding the compound from a mold of the extruder and simultaneously cooling it for solidification, and cutting the resultant long molded body into prescribed lengths, thereby manufacturing a magnet. This molding method has advantages of both the compaction molding method and the injection molding method. More specifically, the extrusion molding method permits freely setting a shape of a magnet through selection of a mold, easy manufacture of a thin-walled or long magnet, and because a high level of melt fluidity is not required, allows molding with a smaller amount of added binding resin than that in the injection molding method, thus contributing to the enhancement of magnetic properties.

As disclosed in Japanese Patent Publication Nos. JP-B-56-31841 and JP-B-56-44561, a thermosetting resin such as an epoxy resin has been used as a binding resin contained in the foregoing compound, and because of the properties of thermosetting resins, it has been possible to use such a small amount of addition as from 0.5 to 4 wt. %.

When employing a thermoplastic resin as the binding resin, however, the effects of the amount of addition and the state of the resin in the bonded magnet on moldability, magnetic properties and mechanical properties have not as yet been clarified.

SUMMARY OF THE INVENTION

It is therefore an object of the present invention to provide a rare earth bonded magnet, bonded with a small amount of thermoplastic resin serving as a binding resin which is excellent in moldability and magnetic properties and has a high mechanical strength, and a composition for a rare earth bonded magnet for the manufacture thereof.

To achieve the foregoing object, the present invention provides a rare earth bonded magnet which contains a rare earth magnet powder and a thermoplastic resin, wherein:

the content of the foregoing thermoplastic resin is within a range of from 1 to 5 wt. %, and the thermoplastic resin covers the outer surface of the rare earth magnet powder and is present so as to prevent adjacent particles of the rare earth magnet powder from coming into contact with each other, whereby a rare earth bonded magnet which is excellent in moldability and magnetic properties and has a high mechanical strength is available with the thermoplastic resin in a slight amount.

The rare earth bonded magnet should preferably further contain an oxidation inhibitor. This inhibits oxidation of the rare earth magnet powder and the thermoplastic resin during the manufacturing process of the magnet, thus making it possible to easily obtain an outer surface coating of the rare earth magnet powder with addition of the thermoplastic resin in a slight amount and to improve moldability.

To achieve the above-mentioned object, as another feature of the present invention, there is provided a rare earth bonded magnet which comprises a rare earth magnet powder, a thermoplastic resin and an oxidation inhibitor, wherein:

the content of the foregoing thermoplastic resin is within a range of from 1 to 3.8 wt. %, whereby a rare earth bonded magnet which is excellent in moldability and magnetic properties and has a high mechanical strength is available with the thermoplastic resin added in a slighter amount.

In these cases, the rare earth bonded magnet should preferably has a void ratio (ratio of void volume to total volume) of no more than 2 vol. %, and this brings about a further improvement of mechanical strength and corrosion resistance of the rare earth bonded magnet.

The thermoplastic resin serving as the binding resin should preferably has a melting point of no more than 400° C. The thermoplastic resin serving as the binding resin preferably has a satisfactory wettability relative to the surface of the rare earth magnet powder. The thermoplastic resin having such properties should preferably be one selected from the group consisting of polyamide, a liquid crystal polymer and polyphenylene sulfide.

The rare earth magnet powder used in the present invention should preferably comprise at least one selected from the group consisting of a first composition which comprises rare earth elements mainly including Sm and transition metals mainly including Co as main ingredients, a second composition which comprises R (R represents at least one selected from rare earth elements including Y), transition metals mainly including Fe, and B as main ingredients, and a third composition which comprises rare earth elements mainly including Sm, transition metals mainly including Fe and interstitial elements mainly including N as main ingredients. This makes it available a rare earth bonded magnet having further excellent magnetic properties.

The rare earth magnet powder used in the present invention should preferably be a mixture of two or more kinds of magnet powder having different compositions and/or different average particle diameters. When using two or more different kinds of magnet powder, the resultant magnet can be provided with advantages of these kinds of magnet powder in mixture, thus making it easier to obtain further excellent magnetic properties. When using two or more kinds of magnet powder having different average particle diameters, sufficient mixing and kneading ensures a higher probability of achieving a state in which magnet powder particles of smaller particle diameters come between those of larger particle diameters, thus allowing increasing the packing ratio of magnet powder particles within the compound.

When using a mixture of two or more kinds of anisotropic magnet powder, orientation of the magnet can further be improved.

The oxidation inhibitor contained in the rare earth bonded magnet should preferably be a chelating agent generating a chelate compound in the presence of metal ions. The chelating agent has particularly a high oxidation preventive effect.

To achieve the foregoing object, as another feature of the present invention, there is provided a composition for a rare earth bonded magnet, containing a rare earth magnet powder, a thermoplastic resin and an oxidation inhibitor, for manufacturing a rare earth bonded magnet, wherein:

the amounts of added thermoplastic resin and oxidation inhibitor are such that, when the foregoing composition for a rare earth bonded magnet is extruded, a fluidity sufficient for permitting extrusion is ensured upon extrusion. It is thus possible to easily manufacture a rare earth bonded magnet excellent in magnetic properties and having a high mechanical strength through full utilization of the advantages of extrusion which provide a high versatility on shape and a high productivity.

In this case, the oxidation inhibitor should preferably be a chelating agent which generates a chelate compound in the presence of metal ions. The chelating agent has particularly a high oxidation preventive effect.

Preferable conditions for ensuring a necessary and sufficient fluidity upon extrusion include an amount of added thermoplastic resin within a range of from 1 to 3.8 wt. % in the composition for a rare earth bonded magnet, and an amount of added oxidation inhibitor within a range of from 0.1 to 2.0 wt. %. The total amount of added thermoplastic resin and oxidation inhibitor should preferably be within a range of from 1.1 to 4.7 wt. %.

The composition for a rare earth bonded magnet should preferably contain at least one of a plasticizer plasticizing the foregoing thermoplastic resin and a lubricant. This further improves fluidity of the material during kneading of the composition for a rare earth bonded magnet or during molding of a bonded magnet.

To achieve the foregoing object, as further another feature of the present invention, there is provided a composition for a rare earth bonded magnet for manufacturing a rare earth bonded magnet, which contains a rare earth magnet powder, a thermoplastic resin and an oxidation inhibitor, wherein:

the amounts of addition of the foregoing thermoplastic resin and the foregoing oxidation inhibitor are such that, when manufacturing a bonded magnet through extrusion by the use of the foregoing composition for a rare earth bonded magnet, a fluidity sufficient to permit extrusion molding thereof is ensured during the molding extrusion, and the resultant rare earth bonded magnet has a void ratio of no more than 2 vol. %. It is thus possible to easily manufacture, through extrusion, a rare earth bonded magnet having further enhanced magnetic properties and mechanical strength.

In this case, the thermoplastic resin should preferably be any one selected from the group consisting of polyamide, a liquid crystal polymer and polyphenylene sulfide, and the amount of addition thereof should preferably be within a range of from 1 to 3.8 wt. %. The oxidation inhibitor should preferably be a chelating agent generating a chelate compound in the presence of metal ions, and the amount off addition thereof should preferably be within a range of from 0.1 to 2.0 wt. %.

The foregoing compositions for a rare earth bonded magnet should preferably be a kneaded mass formed by kneading a rare earth magnet powder, a thermoplastic resin and an oxidation inhibitor at a temperature at which the thermoplastic resin melts or softens. Use of such a composition for a rare earth bonded magnet further improves moldability during extrusion.

Other objects, constructions and effects of the present invention will be clarified from examples presented later.

DETAILED DESCRIPTION OF THE PREFERRED EMBODIMENTS

Figure 1:
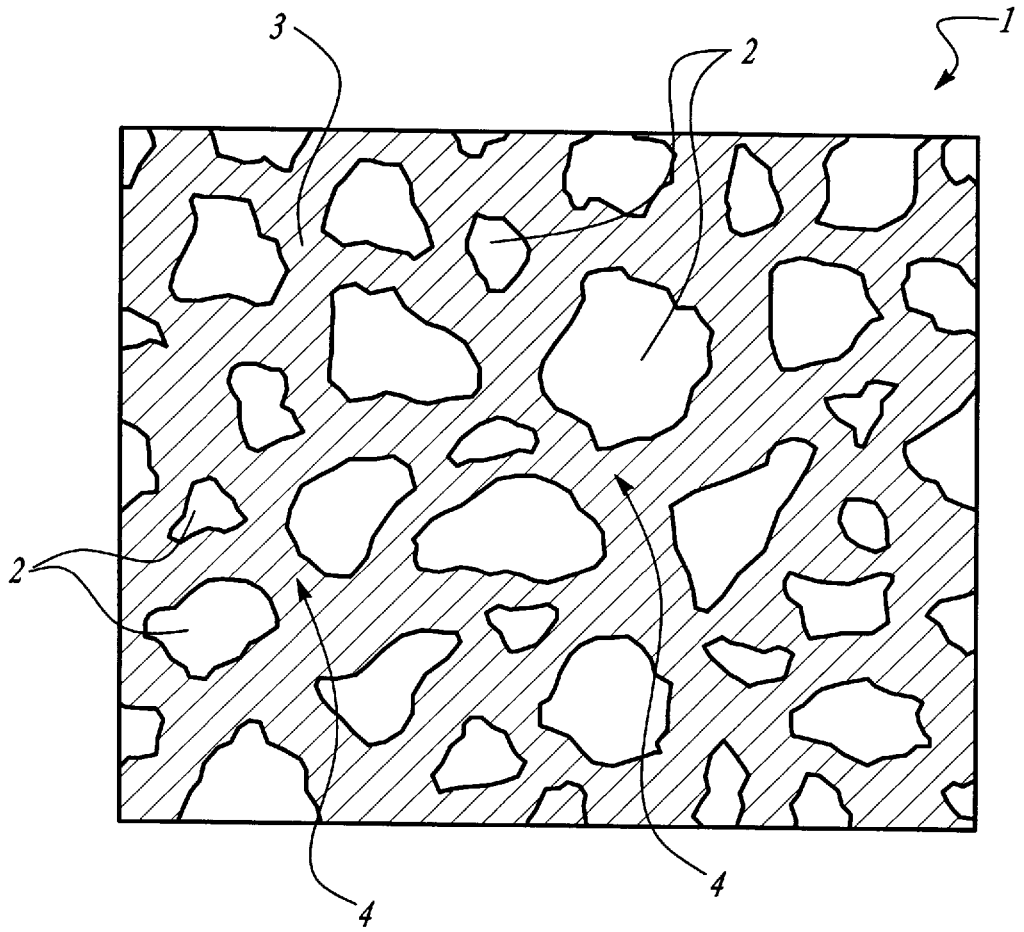
FIG. 1 is an enlarged sectional view illustrating a modelled section of the rare earth bonded magnet of the present invention.

Now, the rare earth bonded magnet and the composition for a rare earth bonded magnet of the present invention will be described below in detail with reference to the drawings.

First, the rare earth bonded magnet of the present invention will be described. The rare earth bonded magnet of the present invention contains the following rare earth magnet powder and thermoplastic resin, and as required, further contains an oxidation inhibitor.

1. Rare earth magnet powder

A rare earth magnet powder should preferably comprise an alloy containing at least one rare earth element and at least one transition metal, and particularly preferable are the following alloys [1] to [5]:

[1] An alloy comprising, as main ingredients, rare earth elements mainly including Sm (this language means that either only $S_M$ is included or $S_M$ and one more rare earth elements in which case Sm has the highest proportion) and transition metals mainly including Co (hereinafter referred to as "Sm—Co alloy").

[2] An alloy comprising, as main ingredients, R (R represents at least one of rare earth elements including Y), transition metals mainly including Fe, and B (hereinafter referred to as "R—Fe—B alloy").

[3] An alloy comprising, as main ingredients, rare earth elements mainly including Sm, transition metals mainly including Fe, and interstitial elements mainly including N (hereinafter referred to as "Sm—Fe—N alloy").

[4] An alloy comprising, as main ingredients, R (R represent at least one of rare earth elements including Y) and transition metals such as Fe, and having a magnetic phase on nanometer level (nanocrystalline magnet).

[5] An alloy comprising a mixture of at least two of the foregoing compositions [1] to [4].

With this composition, the resultant magnet can have advantages of all the kinds of magnet powder in the mixture, particularly in magnetic properties, thus making it possible to easily obtain more excellent magnetic properties. Especially when mixing two or more kinds of anisotropic magnetic powder, the resultant magnet has an improved degree of alignment.

Typical Sm—Co alloys include $SmCo_5$ and $Sm_2TM_{17}$ (where, TM is a transition metal).

Typical R—Fe—B alloys include Nd—Fe—B alloy, Pr—Fe—B alloy, Nd—Pr—Fe—B alloy, Ce—Nd—Fe—B alloy, Ce—Pr—Nd—Fe—B alloy and alloys resulting from partial substitution of Fe of the foregoing alloys by Ni, Co or any other transition metal.

Typical Sm—Fe—N alloys include $Sm_2Fe_{17}N_3$ formed by nitriding an $Sm_2Fe_{17}$ alloy.

Rare earth elements used in the magnetic powder include Y, La, Ce, Pr, Nd, Pm, Sm, Eu, Gd, Tb, Dy, Ho, Er, Tm, Yb, Lu and Mischmetal, and one or more thereof can be contained. Applicable transition metals include Fe, Co and Ni, and one or more can be contained. With a view to improving magnetic properties, the magnet powder may contain, as required, B, Al, Mo, Cu, Ga, Si, Ti, Ta, Zr, Hf, Ag or Zn.

While there is no particular restriction on the average particle diameter of the magnet powder, the average particle diameter should preferably be within a range of from about 0.5 to 50 $\mu$m, or more preferably, from 1 to 30 $\mu$m. The average particle diameter of the magnet powder can be measured, for example, by the F.S.S.S. (Fischer sub-sieve sizer) method.

For the purpose of obtaining a satisfactory moldability in injection molding or extrusion molding with a small amount of binding resin as described later, the particle diameter distribution of the magnet powder should preferably be dispersed to some extent. This permits reduction of the vacancy ratio of the resultant bonded magnet.

In the case of composition [5] as described above, the average particle diameter may differ between individual compositions of magnet powder to be mixed. When using a mixture of two or more kinds of magnet powder of different particle diameters, sufficient mixing and kneading ensures a higher probability of achieving a state in which magnet powder particles of smaller particle diameters come between those of larger particle diameters, thus allowing an increased packing density of magnet powder particles within the compound, hence contributing to the improvement of magnetic properties of the resultant bonded magnet.

There is no particular restriction on the method of manufacturing a magnet powder: for example, a product available by making an alloy ingot by melting and casting the alloy and then milling (and screening) this alloy ingot to an appropriate particle size, or a product available by manufacturing a melt spun ribbon (a collection of fine polycrystals) in a melt spinning apparatus for manufacturing amorphous alloy, and milling (and screening) this ribbon into an appropriate particle size may be used.

2. Binding resin (binder)

A thermoplastic resin is used as the binding resin (binder). When employing a thermosetting resin such as an epoxy resin conventionally used as a binding resin, the poor fluidity during molding leads to a low moldability, an increased vacancy ratio, and low mechanical strength and corrosion resistance. When employing a thermoplastic resin, in contrast, these problems are solved. This provides a wider selection including one giving a high moldability, or one giving higher heat resistance and mechanical strength, varying with the kind and extent of copolymerization.

Applicable thermoplastic resins include, for example, polyamide (eg: nylon 6, nylon 46, nylon 66, nylon 610, nylon 612, nylon 11, nylon 12, nylon 6–12, nylon 6–66), thermoplastic polyamide, liquid crystal polymers such as aromatic polymer, polyphenylene oxide, polyphenylene sulfide, polyethylene, polyolefin such as polypropylene, denatured polyolefin, polycarbonate, polymetacrylate, polyether, polyetherketone, polyetherimide, polyacetal, and copolymers, blends and polymer alloys mainly comprising any of the above. One or more of these resins may be used in mixture.

Among the thermoplastic resins enumerated above, those mainly comprising any of polyamide, liquid crystal polymer and polyphenylene sulfide are preferable because of a satisfactory wettability relative to the surface of the magnet powder, resulting coverage of the outer surface of magnet powder (coated resin state), and a high mechanical strength. Polyamide is preferable also for remarkable improvement of moldability, and liquid crystal polymer and polyphenylene sulfide are preferable also for improvement of heat resistance respectively.

The thermoplastic resins provide a wider selection enabling to select those placing point on moldability, or on heat resistance or mechanical strength.

The thermoplastic resin used in the present invention should preferably have a melting point of no more than 400° C., or more preferably, no more than 300° C. A melting point of over 400° C. leads to an increase in molding temperature and easier occurrence of oxidation of the magnetic powder or the like.

With a view to further improving wettability to the magnet powder surface, fluidity and moldability, the average molecular weight (degree of polymerization) of the thermoplastic resin used in the present invention should preferably be within a range of from about 10,000 to 60,000, or more preferably, from about 12,000 to 30,000.

The content of the thermoplastic resin in a bonded magnet should be within a range of from about 1 to 5 wt. %, or preferably, from about 1 to 4.3 wt. %. When adding an oxidation inhibitor described later, the content of the thermoplastic resin should preferably be within a range of from about 1 to 3.8 wt. %, or more preferably, from about 1.0 to 3.6 wt. %. A lower content of the thermoplastic resin makes it difficult to conduct sufficient kneading with the magnet powder during manufacturing, and leads to a lower moldability, to easier occurrence of contact between adjacent particles of magnet powder, thus preventing a magnet having a low vacancy ratio and a high mechanical strength from being obtained. A higher content of the thermoplastic resin results in poorer magnetic properties although moldability is satisfactory.

FIG. 1 is an enlarged sectional view illustrating a modelled section of the rare earth bonded magnet of the present invention. In the rare earth bonded magnet 1 of the present invention, as shown in FIG. 1, a thermoplastic resin 3 serving as a binding resin covers the outer surface of the particles of magnetic powder 2 in a state that adjacent particles of magnet powder 2 are prevented from coming into contact with each other (hereinafter referred to as the "resin matrix state"). Accordingly, a magnet having a low vacancy ratio, a high mechanical strength, and an excellent corrosion resistance is available even with a relatively small content of the thermoplastic resin as described above. As such, a void 4 is provided between the particles of magnetic powder 2.

This state of the thermoplastic resin is achievable by setting, during the manufacturing process of the rare earth bonded magnet, appropriate kneading conditions of a composition for the rare earth bonded magnet (mixture of the magnet powder, the binding resin and the like) and appropriate molding conditions of the kneaded mass (compound).

3. Oxidation inhibitor

An oxidation inhibitor is an additive added into a composition for a rare earth bonded magnet described later for preventing, upon kneading such a composition, the rare earth magnet powder from being oxidized (deteriorated or denatured) or the binding resin from being oxidized (assumed to occur under the effect of metal ingredients in the rare earth magnet power acting as a catalyst). When adding this oxidation inhibitor, the amount of addition thereof should be within a range of from about 0.05 to 2.5 wt. %. Addition of the oxidation inhibitor brings about the following effects.

First, it prevents oxidation of the rare earth magnet powder and the binding resin and maintains a satisfactory wettability of the binding resin relative to the surface of the rare earth magnet powder, so that it is easy to achieve the foregoing resin matrix state with a small amount of binding resin.

Secondly, since it prevents oxidation of the rare earth magnet powder, it contributes to an improvement of magnetic properties of the resultant magnet, and at the same time, serves to improve thermal stability upon kneading and forming the composition for a rare earth bonded magnet, thus ensuring satisfactory moldability with a small amount of binding resin.

Since the oxidation inhibitor evaporates or decomposes during an intermediate process such as kneading or molding of the composition for a rare earth bonded magnet, part of it is present in a state of residue in the resultant rare earth magnet. The content of the oxidation inhibitor in the rare earth bonded magnet is therefore within a range of from about 10 to 90%, or more particularly, from about 20 to 80% relative to the amount of the oxidation inhibitor added to the composition for a rare earth bonded magnet. As described above, the oxidation inhibitor not only prevents the rare earth magnet powder and the binding resin from being oxidized during manufacture of a magnet, but also contributes to improvement of corrosion resistance of the resultant magnet.

Any agent which is capable of preventing or inhibiting oxidation of the rare earth magnet powder and the binding resin may be used as the oxidation inhibitor: for example, a chelating agent such as an amine compound, an aminoacid compound, a nitrocarboxylic acid, a hydrazine compound, a cyanic compound, a sulfide, preferably one which makes the surface of magnet powder inactive be appropriately used. The chelating agent provides a particularly high oxidation preventive effect. It is needless to mention that the kind and the composition of the oxidation inhibitor are not limited to those enumerated above.

As required, a plasticizer which plasticizes the binding resin (for example, stearic acid salt, fatty acid), a lubricant (for example, silicone oil, any of various waxes, fatty acid, alumina, silica, titania or any other inorganic lubricant), and/or other additives such as a molding additive may be contained in the rare earth bonded magnet of the present invention. Addition of at least any of a plasticizer and a lubricant improves fluidity of the material during kneading of the composition for rare earth bonded magnet or during molding of the bonded magnet.

For this rare earth bonded magnet of the present invention, the void ratio (ratio of void volume to total volume) should preferably be no more than 2 vol. %, or more preferably, no more than 1.5 vol. %. A higher vacancy ratio may result in a decrease in mechanical strength and corrosion resistance, depending upon the chemical composition of the thermoplastic resin, the content thereof, and the chemical composition and particle diameter of the magnet powder.

Because of the chemical composition of the magnet powder and the high content of the magnet powder, the rare earth bonded magnet of the present invention is excellent in magnetic properties, irrespective of whether it is an anisotropic magnet or an isotropic magnet.

More specifically, when the rare earth bonded magnet of the present invention is molded in the absence of magnetic field, a maximum magnetic energy product (BH)max of at least 8 MGOe (64 kJ/m$^3$), particularly of at least 9.5 MGOe (76 kJ/m$^3$), can be achieved. When it is formed in a magnetic field, it is possible to achieve a maximum magnetic energy product (BH)max of at least 12 MGOe (96 kJ/m$^3$), particularly of at least 14 MGOe (112 kJ/m$^3$).

There is no particular restriction of the shape and size of the rare earth bonded magnet of the present invention: for the shape, for example, applicable shapes include a rod shape, a prism shape, a cylindrical shape, an arch shape, a plate shape and all other shapes, and the size thereof may be large or very small.

Now, the composition for a rare earth bonded magnet of the present invention will be described below.

The composition for a rare earth bonded magnet of the present invention contains, as main ingredients, the foregoing rare earth magnet powder, the foregoing thermoplastic resin, and the foregoing oxidation inhibitor.

In this case, the amount of addition of the thermoplastic resin and the oxidation inhibitor should be such that, when manufacturing the bonded magnet by extruding the composition for a rare earth bonded magnet, a necessary and sufficient fluidity of a melt of that composition is ensured during molding, and particularly, such that a void ratio of no more than 2 vol. % is achieved for the resultant rare earth bonded magnet.

These amounts vary with various conditions such as the kind of thermoplastic resin and oxidation inhibitor for the composition of magnet itself, molding method, temperature, pressure and other molding conditions, and the shape and size of the molded product. In a typical example, the amount of addition of the thermoplastic resin in the composition for a rare earth bonded magnet should preferably be within a range of from about 1 to 3.8 wt. %, or more preferably, from about 1.1 to 3.6 wt. %. The amount of addition of the oxidation inhibitor in the composition for rare earth bonded magnet should preferably be within a range of from about 0.1 to 2.0 wt. %, or more preferably, from about 0.5 to 1.8 wt. %. As the oxidation inhibitor, it is desirable to use a chelating agent as described above, as giving a particularly high oxidation preventive effect.

Because the oxidation inhibitor is added to the composition for a rare earth bonded magnet, it is possible to achieve a satisfactory extrusion even with a small amount of added binding resin as described above. With an amount of added thermoplastic resin of less than 1 wt. % in the composition for a rare earth bonded magnet, however, the viscosity of the kneaded mass becomes higher, causing an increased torque during kneading, and heat generation tends to accelerate oxidation of the magnet powder and the binding resin. When the amount of added oxidation inhibitor is small, therefore, it becomes impossible to sufficiently inhibit oxidation of the magnet powder and the binding resin, and the increase in viscosity of the kneaded mass (molten resin) causes deterioration of moldability, thus making it impossible to obtain a magnet having a low void ratio and a high mechanical strength. An amount of added thermoplastic resin of more than 3.8 wt. %, while improving moldability, may be disadvantageous for achieving outstanding magnetic properties, depending upon the chemical composition of the magnet powder, particle diameter and other conditions.

When the amount of added oxidation inhibitor in the composition for a rare earth bonded magnet is under 0.1 wt. %, on the other hand, there is available only a limited oxidation preventive effect, and if the amount of added thermoplastic resin is small, oxidation of the magnet powder cannot sufficiently be inhibited. With an amount of added oxidation inhibitor of over 2.0 wt. %, the amount of resin relatively decreases, leading to a decreased mechanical strength of the resultant molded product.

When the amount of the thermoplastic resin is relatively large, as described above, it is possible to reduce the amount of added oxidation inhibitor, and when the amount of added thermoplastic resin is small, in contrast, it is necessary to increase the amount of added oxidation inhibitor. The total amount of the thermoplastic resin and the oxidation inhibitor should therefore preferably be within a range of from about 1.1 to 4.7 wt. %, or more preferably, from about 1.1 to 4.5 wt. %.

Any of the various additives as described above can be added as required to the composition for a rare earth bonded magnet.

As the addition of a plasticizer improves fluidity during molding, similar fluidity levels are available with a smaller amount of binding resin. This is also the case with the addition of the lubricant. The amount of addition of the plasticizer and the lubricant should preferably be within a range of from about 0.01 to 0.3 wt. %, or more preferably, from about 0.05 to 0.2 wt. %. With these amounts of addition, the plasticizer and the lubricant can effectively show their respective favorable functions.

Applicable forms of the composition for a rare earth bonded magnet include a mixture of a rare earth magnet powder, a thermoplastic resin and an oxidation inhibitor, a kneaded mass formed by kneading the foregoing mixture, and pellets of this kneaded mass (for example, of a particle diameter of from 1 to 12 mm). Use of such a kneaded mass or pellets further improves moldability in extrusion.

Kneading of the foregoing mixture is accomplished by means, for example, of a roll mill, a kneader or a twin screw extruder.

During the kneading process, the kneading temperature, which is appropriately determined depending on the chemical composition of the thermoplastic resin and properties thereof, should preferably be at least the thermal deformation temperature or the softening temperature (softening point or glass transition point) of the thermoplastic resin. When the thermoplastic resin has a relatively low melting point, the kneading temperature should preferably be near, or higher than, the melting point of the thermoplastic resin.

Kneading at such a temperature enhances the kneading efficiency and permits uniform kneading in a shorter period of time. As kneading is conducted with a decreased viscosity of the thermoplastic resin, this easily results in the state in which the thermoplastic resin covers the rare earth magnetic powder particles, and contributes to reduction of the vacancy ratio of the resultant rare earth bonded magnet.

The rare earth bonded magnet of the present invention is manufactured, for example, as follows.

The composition (mixture) for a rare earth bonded magnet containing the foregoing proportions of earth magnet powder, thermoplastic resin, and preferably, the oxidation inhibitor is sufficiently kneaded at the above-mentioned kneading temperature by means of a kneader or the like, thereby obtaining a kneaded mass of the composition for a rare earth bonded magnet.

Then, the resultant kneaded mass (compound) of the rare earth bonded magnet is extruded by an extruder while heating it at a temperature of at least the melting point of the thermoplastic resin (for a polyamide resin, for example, a temperature of from 120° to 230° C.), and after cooling, cut into desired lengths, thereby obtaining rare earth bonded magnets. The kneaded mass subjected to extrusion may be in the form of pellets.

Another method comprises the steps of packing a mixture or a kneaded mass (compound) of the composition for a rare earth bonded magnet containing the foregoing rare earth magnet powder, thermoplastic resin, and preferably, oxidation inhibitor into a press mold, and applying a pressure within a range, for example, of from about 0.5 to 3.0 tons/cm$^2$ (49 to 294 Mpa) onto it while heating it to a temperature of at least the melting temperature of the thermoplastic resin (for a polyamide resin, for example, a temperature of from 180° to 200° C.) for compression molding, thereby obtaining a rare earth bonded magnet of a desired shape.

EXAMPLES

Now, the present invention will be described below further in detail by means of examples.

(Example 1)

First, 96 wt. % Nd—Fe—B-based magnet powder (rapid-quenched $Nd_{12}Fe_{82}B_6$ powder; average particle diameter: 20 $\mu$m), 3.4 wt. % polyamide (melting point: 175° C.) and 0.6 wt. % hydrazine-based oxidation inhibitor (chelating agent) were kneaded at 230° C. by means of an extruder for kneading, and extruded into a round bar having a diameter of 10 mm at 250° C. At this point, the total kneading disk part length in the barrel of the extruder (standard of kneading intensity) was 15 cm. The resultant round bar was cut into lengths of 7 mm, thereby completing a rare earth bonded magnet of the present invention.

Analysis of the chemical composition of the resultant rare earth bonded magnet showed a polyamide content of 3.6 wt. %.

Evaluation of properties of this rare earth bonded magnet showed a magnetic energy product (BH)max=9.5 MGOe (76 kJ/m$^3$), a density $\rho$=6.06 g/cm$^3$, and a void ratio of 1.3 vol. %.

(Example 2)

A rare earth bonded magnet of the present invention was manufactured in the same manner as in Example 1 except that the chemical composition of the compound comprised 96 wt. % Nd—Fe—B-based magnet powder (rapid-quenched $Nd_{12}Fe_{82}B_6$ powder; average particle diameter= 19 $\mu$m), 3.0 wt. % polyamide (melting point=175° C.), and 1.0 wt. % hydrazine-based oxidation inhibitor (chelating agent). The kneading torque in the kneader was about 80% of that in Example 1.

Analysis of the chemical composition of the resultant rare earth bonded magnet showed a polyamide content of 3.3 wt. %.

Evaluation of properties of this rare earth bonded magnet showed a magnetic energy product (BH)max=10.3 MGOe (82 kJ/m$^3$), a density $\rho$=6.13 g/cm$^3$, and a void ratio of 1.1 vol. %.

(Example 3)

A rare earth bonded magnet of the present invention was manufactured in the same manner as in Example 1 except that the chemical composition of the compound comprised 96.3 wt. % Nd—Fe—B-based magnet powder (rapid-quenched $Nd_{12}Fe_{82}B_6$ powder; average particle diameter= 18 μm), 2.5 wt. % polyamide (melting point=175° C.), and 1.2 wt. % hydrazine-based oxidation inhibitor (chelating agent). As the total length of the kneading disk part in the kneading extruder was extended to 20 cm, the kneading torque was about 120% of that in Example 1.

Analysis of the chemical composition of the resultant rare earth bonded magnet showed a polyamide content of 2.9 wt. %.

Evaluation of properties of this rare earth bonded magnet showed a magnetic energy product (BH)max=11.6 MGOe (92.8 kJ/m$^3$), a density ρ=6.21 g/cm$^3$, and a void ratio of 1.2 vol. %.

(Example 4)

A rare earth bonded magnet of the present invention was manufactured in the same manner as in Example 1 except that the chemical composition of the compound comprised 97.3 wt. % Nd—Fe—B-based magnet powder (rapid-quenched $Nd_{12}Fe_{82}B_6$ powder; average particle diameter= 21 μm), 1.0 wt. % polyamide (melting point=175° C.), 1.5 wt. % hydrazine-based oxidation inhibitor (chelating agent), and 0.2 wt. % zinc isostearate (plasticizer). As the total length of the kneading disk part in the kneading extrude was extended to 30 cm, the kneading torque was about 150% of that in Example 1.

Analysis of the chemical composition of the resultant rare earth bonded magnet showed a polyamide content of 1.3 wt. %.

Evaluation of properties of this rare earth bonded magnet showed a magnetic energy product (BH)max=14.3 MGOe (114 kj/m$^3$), a density ρ=6.54 g/cm$^3$, and a void ratio of 3 vol. %.

(Example 5)

The compound of Example 1 was continuously extruded under the same conditions as in Example 1 into a cylinder having an outside diameter of 18 mm and a wall thickness of 0.8 mm, and the resultant cylinder was cut into lengths of 7 mm, thereby manufacturing cylindrical rare earth bonded magnets.

The resultant rare earth bonded magnet had almost the same chemical composition and properties as in Example 1.

(Example 6)

The compound of Example 3 was continuously extruded under the same conditions as in Example 3 into a cylinder having an outside diameter of 18 mm and a wall thickness of 0.8 mm, and the resultant cylinder was cut into lengths of 7 mm, thereby manufacturing cylindrical rare earth bonded magnets.

The resultant rare earth bonded magnet had almost the same chemical composition and properties as in Example 3.

(Example 7)

The compound of Example 4 was compression-molded by a press molding machine at a temperature of 225° C. under a pressure of 1 ton/cm$^2$ into a cylindrical rare earth bonded magnet having an outside diameter of 18 mm, a wall thickness of 0.8 mm and a length of 7 mm.

The resultant rare earth bonded magnet had almost the same chemical composition and properties as in Example 4.

(Example 8)

A magnet powder comprising Sm $(Co_{0.604}CU_{0.06}Fe_{0.32}Zr_{0.016})_{8.3}$ in an amount of 96 wt. % (average particle diameter=24 μm) 3.4 wt. % polyamide (melting point=175° C.) and 0.6 wt. % hydrazine-based oxidation inhibitor (chelating agent) were kneaded in a kneader at 230° C. The total length of the kneading disk part in the kneading extruder was extended to 30 cm, and the kneading torque was about 120% of that in Example 1.

The resultant compound was compression-molded by means of a press molding machine in an alignment magnetic field of 15 kOe at a temperature of 230° C. under a pressure of 1 ton/cm$^2$, thereby manufacturing a cylindrical rare earth bonded magnet having an outside diameter of 18 mm, a wall thickness of 0.8 mm and a length of 7 mm.

Analysis of the chemical composition of the resultant rare earth bonded magnet showed a polyamide content of 3.6 wt. %.

Evaluation of properties of this rare earth bonded magnet showed a magnetic energy product (BH)max=20.7 MGOe (166 kJ/m$^3$), a density ρ=7.35 g/cm$^3$, and a void ratio of 1.5 vol. %.

(Example 9)

A rare earth bonded magnet of the present invention was manufactured in the same manner as in Example 1, except that the chemical composition of the compound comprised 96 wt. % Nd—Fe—B-based magnet powder (rapid-quenched $Nd_{12}Fe_{82}B_6$ powder; average particles diameter= 17 μm), 3.0 wt. % liquid crystal polymer (melting point= 180° C.), and 1.0 wt. % hydrazine-based oxidation inhibitor (chelating agent) at a kneading temperature of 250° C. The kneading torque was about 125% of that in Example 1.

Analysis of the chemical composition of the resultant rare earth bonded magnet showed a liquid crystal polymer content of 3.4 wt. %.

Evaluation of properties of this rare earth bonded magnet showed a magnetic energy product (BH)max=9.8 MGOe, a density ρ=6.14 g/cm$^3$, and a void ratio of 1.3 vol. %.

(Example 10)

A rare earth bonded magnet of the present invention was manufactured in the same manner as in Example 1 except that the chemical composition of the compound comprised 96.2 wt. % Nd—Fe—B-based magnet powder (rapid-quenched $Nd_{12}Fe_{82}B_6$ powder; average particle diameter= 19 μm), 2.5 wt. % liquid crystal polymer (melting point= 180° C.), and 1.3 wt. % hydrazine-based oxidation inhibitor (chelating agent), at a kneading temperature of 250° C.

Analysis of the chemical composition of the resultant rare earth bonded magnet showed a liquid crystal polymer content of 3.0 wt. %.

Evaluation of properties of this rare earth bonded magnet showed a magnetic average product (BH)max=10.4 MGOe (83 kJ/m$^3$), a density ρ=6.17 g/cm$^3$, and a void ratio of 1.2 vol. %.

(Example 11)

A rare earth bonded magnet of the present invention was manufactured in the same manner as in Example 1 except that the chemical composition of the compound comprised 97 wt. % magnet powder comprising $Sm_2Fe_{17}N_3$ (average particle diameter=1.5 μm), 1.4 wt. % polyamide (melting point=175° C.), 1.4 wt. % hydrazine-based oxidation inhibitor (chelating agent), and 0.2 wt. % zinc isostearate (plasticizer). The total length of the kneading disk part in the kneading extruder was set at 30 cm.

Analysis of the chemical composition of the resultant rare earth bonded magnet showed a polyamide content of 1.8 wt. %.

Evaluation of properties of this rare earth bonded magnet showed a magnetic energy product (BH)max=21.3 MGOe (170 kJ/m$^3$), a density ρ=6.6 g/cm$^3$, and a void ratio of 1.2 vol. %.

(Example 12)

A rare earth bonded magnet of the present invention was manufactured in the same manner as in Example 1 except that the chemical composition of the compound comprised 96.2 wt. % magnet powder comprising $Sm_2Fe_{17}N_3$ (average particle diameter=1.0 μm), 2.0 wt. % liquid crystal polymer (melting point=180° C.), 1.5 wt. % hydrazine-based oxidation inhibitor (chelating agent), 0.2 wt. % zinc isostearate (plasticizer), and 0.1 wt. % silicone oil (lubricant) at a kneading temperature of 250° C. The total length of the kneading disk part in the kneading extruder was set at 30 cm.

Analysis of the chemical composition of the resultant rare earth bonded magnet showed a liquid crystal polymer content of 2.5 wt. %.

Evaluation of properties of this rare earth bonded magnet showed a magnetic energy product (BH)max=20.6 MGOe (165 kJ/m$^3$), a density ρ=6.54 g/cm$^3$, and a void ratio of 1.1 vol. %.

(Example 13)

A magnet powder comprising Sm $(Co_{0.604}CU_{0.06}Fe_{0.32}Zr_{0.016})_{8.3}$ in an amount of 72 wt. % (average particle diameter=22 μm), 24 wt. % magnet powder comprising $Sm_2Fe_{17}N_3$ (average particle diameter=1.2 μm), 3.4 wt. % polyamide (melting point=175° C.), and 0.6 wt. % hydrazine-based oxidation inhibitor (chelating agent) were kneaded in a kneader at 230° C. The total length of the kneading disk part in the kneading extruder was 30 cm, and the kneading torque was about 140% of that in Example 1.

The resultant compound was compression-molded by means of a press molding machine in a magnetic field of an alignment field of 15 kOe at a temperature of 230° C. under a pressure of 1 ton/cm$^2$, thereby manufacturing a cylindrical rare earth bonded magnet having an outside diameter of 18 mm, a wall thickness of 0.8 mm, and a length of 7 mm.

Analysis of the chemical composition of the resultant rare earth bonded magnet showed a polyamide content of 3.7 wt. %.

Evaluation of properties of this rare earth bonded magnet showed a magnetic energy product (BH)max=22.5 MGOe (180 kJ/m$^3$), a density ρ=7.27 g/cm$^3$, and a void ratio of 1.1 vol. %.

(Example 14)

A magnet powder comprising Sm $(Co_{0.604}CU_{0.06}Fe_{0.32}Zr_{0.016})_{8.3}$ in an amount of 50 wt. % (average particle diameter 22 μm), 27.3 wt. % magnet powder comprising $Sm_2Fe_{17}N_3$ (average particle diameter= 1.2 μm), 20 wt. % anisotropic Nd—Fe—B-based magnet powder (average particle diameter=17 μm), 1.0 wt. % polyphenylene sulfide, 1.5 wt. % hydrazine-based oxidation inhibitor (chelating agent), and 0.2 wt. % zinc isostearate (plasticizer) were kneaded by means of a kneader at 300° C. The kneading disk part in the kneading extruder had a total length of 30 cm, and the kneading torque was about 170% of that in Example 1.

The resultant compound was compression-molded by means of a press molding machine in a magnetic field of an alignment field of 18 kOe at a temperature of 300° C. under a pressure of 2 tons/cm$^2$ (196 MPa), thereby manufacturing a round bar-shaped rare earth bonded magnet having a diameter of 10 mm and a length of 7 mm.

Analysis of the chemical composition of the resultant rare earth bonded magnet showed a polyphenylene sulfide content of 1.4 wt. %.

Evaluation of properties of this rare earth bonded magnet showed a magnetic energy product (BH)max=20.1 MGOe (161 kJ/m$^3$), a density =ρ7.20 g/cm$^3$ and a void ratio of 1.1 vol. %.

All the rare earth bonded magnets of the foregoing Examples 1 to 14 were confirmed to be excellent in moldability, with a low void ratio, a high mechanical strength and excellent magnetic properties.

(Comparative Example 1)

Each of the following three materials:

(a) 99.0 wt. % Nd—Fe—B-based magnet powder (rapid-quenched $Nd_{12}Fe_{82}B_6$ powder; average particle diameter=19 μm)+1.0 wt. % epoxy resin;

(b) 97.0 wt. % Nd—Fe—B-based magnet powder (rapid-quenched $Nd_{12}Fe_{82}B_6$ powder; average particle diameter=20 μm)+3.0 wt. % epoxy resin;

(c) 95.0 wt. % Nd—Fe—B-based magnet powder (rapid-quenched $Nd_{12}Fe_{82}B_6$ powder; average particle diameter=21 μm)+5.0 wt. % epoxy resin, was kneaded by a kneading extruder at the room temperature, and the resultant compound was compaction-molded in a press molding machine under a pressure of 5 tons/cm$^2$ (490 MPa), thereby forming a rod-shaped block having a diameter of 10 mm and a length of 7 mm. Subsequently, the molded block was cured at 150° C. for one hour for setting the resin, thereby manufacturing a rare earth bonded magnet.

Because bonding between the magnet powder and the binding resin (thermoplastic resin) was insufficient in the rare earth bonded magnet obtained from (a), the magnet powder came off in response to a slight shock, making it impossible to apply this magnet in practical use.

For the rare earth bonded magnet manufactured from (b), the viscosity decreased during heat treatment causing discharge of the resin, and after setting of the resin, the discharged resin covered the surface of the magnet, thus making it impossible to evaluate magnetic properties.

For the rare earth bonded magnet derived from (c), the shape could not be maintained upon taking out the block from the press die, thus making it impossible to accomplish molding.

(Comparative Example 2)

In this Example, 99.1 wt. % Nd—Fe—B-based magnet powder (rapid-quenched $Nd_{12}Fe_{82}B_6$ powder; average particle diameter=22 μm), and 0.9 wt. % polyamide (melting point=175° C.) were kneaded by a kneader at 230° C. At this point, the kneading torque was very large, making it impossible to permit sufficient kneading, and heat generation led to serious oxidation of the magnet powder.

Extrusion could not be accomplished from the resultant compound. Accordingly, the foregoing compound was compression-molded in a press forming machine at 230° C. under a pressure of 3.0 tons/cm$^2$ (294 Mpa) into a cylindrical rare earth bonded magnet having a diameter of 10 mm, and a length of 7 mm.

For the resultant rare earth bonded magnet, magnetic properties were measured: exposing the magnet to a magnetic field shock caused peeling and falling of the magnet powder (this language means that because of magnetic field shock, binder can not keep binding magnetic power), thus making it impossible to practically use this magnet.

(Example 15 to 26)

There were provided seven kinds of rare earth magnet powder having any of the following seven chemical compositions (1) to (7), the following three kinds of thermoplastic resin (binding resin) A, B and C, a hydrazine-based oxidation inhibitor (chelating agent), zinc stearate (plasticizer) and a silicone oil (lubricant), and were mixed in prescribed combinations. Each of the resultant mixtures was kneaded under the conditions shown in Tables 1 and 2, and the resultant composition (compound) for a rare earth bonded magnet was molded under the molding conditions shown in these Tables, thereby obtaining a rare earth bonded magnet of the present invention. The shape, size, chemical composition, state and properties of the resultant magnets are shown in Tables 3 and 4.

(1) Rapid-Quenched $Nd_{12}Fe_{82}B_6$ (average particle diameter=19 μm);

(2) Rapid-Quenched $Nd_3Pr_4Fe_{82}B_6$ powder (average particle diameter=18 μm);

(3) Rapid-Quenched $Nd_{12}Fe_{78}Co_4B_6$ powder (average particle diameter=20 μm);

(4) Sm $(Co_{0.604}CU_{0.06}Fe_{0.32}Zr_{0.016})_{8.3}$ powder (average particle diameter=22 μm);

(5) $Sm_2Fe_{17}N_3$ powder (average particle diameter=2 μm);

(6) Anisotropic $Nd_{13}Fe_{69}C_{11}B_6$ powder based on the HDDR method (average particle diameter=30 μm);

(7) Nanocrystalline $Nd_{5.5}Fe_{66}B_{18.5}Co_5Cr_5$ powder (average particle diameter=15 μm)

A. Polyamide (nylon 12); melting point: 175° C.;

B. Liquid crystal polymer; melting point: 180° C.;

C. Polyphenylene sulfide (PPS); melting point: 280° C.

The state of resin as shown in Tables 3 and 4 was evaluated by cutting the resultant magnet and taking a photograph with an electron microscope (magnifications of 100) of the sectional surface.

The mechanical strength in Tables 3 and 4 was evaluated by separately preparing test pieces having an outside diameter of 15 mm and a height of 3 mm, subjecting each such test piece to press molding in the absence of a magnetic field at any of the molding temperatures shown in Tables 1 and 2 under a pressure of 1.5 tons/cm$^2$ (147 MPa), and evaluating the mechanical strength by shearing by punching.

The values of corrosion resistance shown in Tables 3 and 4 are the results of an acceleration test carried out on the resultant rare earth bonded magnets in an isothermal/iso-humidity vessel under conditions including 80° C. and 90% RH. The corrosion resistance was evaluated by means of the time before occurrence of rust with four marks: ◎, ○, Δ, and X.

(Comparative Examples 3 and 4)

A mixture of the rare earth magnet powder having the chemical composition (1) above and epoxy resin (thermosetting resin) was kneaded under the conditions shown in Table 2. The resultant compound was molded under the molding conditions shown in Table 2. The molding product was subjected to a heat treatment at 150° C. for one hour for resin setting, thereby obtaining a rare earth bonded magnet. The shape, size, chemical composition, state and properties of the resultant magnets are shown in Table 4. In Table 4, evaluation of the state of resin, mechanical strength (the test pieces were press-molded at room temperature under a pressure of 7 tons/cm$^2$ (686 MPa)) and corrosion resistance was carried out in the same manner as in the above Example.

(Comparative Example 5)

The mixture of the rare earth magnet powder having the chemical composition (1) above and the thermosetting resin A above was kneaded under the conditions shown in Table 2. The resultant compound was molded under the forming conditions shown in Table 2. The shape, size, chemical composition, state and properties of the resultant magnets are shown in Table 4. Evaluation of the state of resin and the like in Table 4 was conducted in the same manner as in the above Example.

TABLE 1

| | Kneading condition | | | Molding condition | | | |
|---|---|---|---|---|---|---|---|
| | Kneading temp. | Kneading intensity* | Kneading torque | Molding method | Mold temp. | Pressing pressure | Alignment field |
| Example 15 | 230° C. | 15 cm | — | Extrusion molding | 250° C. | — | No magnetic field |
| Example 16 | 230° C. | 15 cm | 0.8 times as large as in Example 1 | Extrusion molding | 250° C. | — | No magnetic field |
| Example 17 | 230° C. | 15 cm | 0.7 times as large as in Example 1 | Extrusion molding | 250° C. | — | No magnetic field |
| Example 18 | 230° C. | 30 cm | 1.6 times as large as in Example 1 | Compression molding | 230° C. | 1.5 t/cm$^2$ | 15 kOe |
| Example 19 | 230° C. | 15 cm | 0.9 times as large as in Example 1 | Extrusion molding | 250° C. | — | No magnetic field |
| Example 20 | 230° C. | 30 cm | 1.5 times as large as in Example 1 | Compression molding | 230° C. | 1.5 t/cm$^2$ | 15 kOe |
| Example 21 | 250° C. | 20 cm | 1.3 times as large as in Example 1 | Extrusion molding | 260° C. | — | 15 kOe |
| Example 22 | 230° C. | 15 cm | 0.9 times as large as in Example 1 | Extrusion molding | 250° C. | — | No magnetic field |

*: Total length of kneading disks in kneading machine.

TABLE 2

| | Kneading condition | | | Molding condition | | | |
|---|---|---|---|---|---|---|---|
| | Kneading temp. | Kneading intensity* | Kneading torque | Molding method | Mold temp. | Pressing pressure | Alignment field |
| Example 23 | 230° C. | 30 cm | 1.6 times as large as in Example 1 | Compression molding | 230° C. | 1.5 t/cm$^2$ | 1.5 kOe |
| Example 24 | 300° C. | 20 cm | 1.5 times as large as in Example 1 | Extrusion molding | 300° C. | — | No magnetic field |
| Example 25 | 300° C. | 30 cm | 1.8 times as large as in Example 1 | Compression molding | 300° C. | 1.8 t/cm$^2$ | 18 kOe |
| Example 26 | 250° C. | 25 cm | 1.5 times as large as in Example 1 | Extrusion molding | 250° C. | — | No magnetic field |
| Comparative example 3 | Room temp. | — | — | Compression molding | Room temp. | 7 t/cm$^2$ | No magnetic field |
| Comparative example 4 | Room temp. | — | — | Compression molding | Room temp. | 7 t/cm$^2$ | No magnetic field |
| Comparative example 5 | 230° C. | Impossible to knead | | Compression molding | — | — | — |

*: Total length of kneading disks in kneading machine.

TABLE 3

| | Shape of magnet | Size of magnet (mm) | Magnet composition (wt %) | Magnetic energy product (BH)max(MGOe) | Density ρ(g/cm$^3$) | Void ratio (%) | State of resin | Mechanical strength (kgf/cm$^2$) | Corrosion resistance |
|---|---|---|---|---|---|---|---|---|---|
| Example 15 | Rod-shaped | DO:15 Length:10 | Magnetic powder 1:96 Polyamide:4 | 9.2 | 6.02 | 1.4 | Outer surface of magnetic powder satisfactorily coated, with almost no mutual contact between particles. | 7.0 | ○ |
| Example 16 | Rod-shaped | DO:15 Length:10 | Magnetic powder 2:96 Polyamide:ab.3 Oxidation inhibitor:trace | 9.9 | 6.11 | 1.2 | Outer surface of magnetic powder satisfactorily coated, with almost no mutual contact between particles. | 6.1 | ◎ |
| Example 17 | Rod-shaped | DO:15 Length:10 | Magnetic powder 3:96 Polyamide:ab.2 Oxidation inhibitor:ab.1 | 11.4 | 6.19 | 1.2 | Outer surface of magnetic powder satisfactorily coated, with almost no mutual contact between particles. | 5.9 | ◎ |
| Example 18 | Rod-shaped | DO:15 Length:10 | Magnetic powder 4:97 Polyamide:ab.1.5 Oxidation inhibitor:trace | 18.6 | 7.11 | 1.3 | Outer surface of magnetic powder satisfactorily coated, with almost no mutual contact between particles. | 5.7 | ◎ |
| Example 19 | Cylindrical | DO:20 Thickness:1.0 Length:10 | Magnetic powder 5:95.5 Polyamide:ab.3 Oxidation inhibitor:trace Plasticizer:trace | 8.7 | 5.76 | 1.1 | Outer surface of magnetic powder satisfactorily coated, with almost no mutual contact between particles. | 7.8 | ○ |
| Example 20 | Cylindrical | DO:20 Thickness:1.0 Length:10 | Magnetic powder 4:74 Magnetic powder 5:23 | 21.8 | 7.23 | 1.2 | Outer surface of magnetic powder satisfactorily | 6.3 | ◎ |

TABLE 3-continued

| | Shape of magnet | Size of magnet (mm) | Magnet composition (wt %) | Magnetic energy product (BH)max(MGOe) | Density ρ(g/cm$^3$) | Void ratio (%) | State of resin | Mechanical strength (kgf/cm$^2$) | Corrosion resistance |
|---|---|---|---|---|---|---|---|---|---|
| | | | Polyamide:ab.1.5<br>Oxidation inhibitor:trace | | | | coated, with almost no mutual contact between particles. | | |
| Example 21 | Cylindrical | DO:20<br>Thickness:1.0<br>Length:10 | Magnetic powder 2:96<br>Liquid crystal polymer:ab.3<br>Oxidation inhibitor:trace | 9.3 | 6.12 | 1.3 | Outer surface of magnetic powder satisfactorily coated, with almost no mutual contact between particles. | 6.2 | ⊙ |
| Example 22 | Rod-shaped | DO:15<br>Length:10 | Magnetic powder 1:73<br>Magnetic powder 7:23<br>Polyamide: 1<br>Plasticizer.lubric ant:trace | 9.0 | 6.06 | 1.1 | Outer surface of magnetic powder satisfactorily coated, with almost no mutual contact between particles. | 6.5 | ⊙ |

TABLE 4

| | Shape of magnet | Size of magnet (mm) | Magnet composition (wt %) | Magnetic energy product (BH)max(MGOe) | Density ρ(g/cm$^3$) | Void ratio (%) | State of resin | Mechanical strength (kgf/cm$^2$) | Corrosion resistance |
|---|---|---|---|---|---|---|---|---|---|
| Example 23 | Rod-shaped | DO:15<br>Length:10 | Magnetic powder 4:73<br>Magnetic powder 6:24<br>Polyamide:ab.1.5<br>Oxidation inhibitor:trace | 23.4 | 7.24 | 1.1 | Outer surface of magnetic powder satisfactorily coated, with almost no mutual contact between particles. | 6.5 | ○ |
| Example 24 | Rod-shaped | DO:15<br>Length:10 | Magnetic powder 3:95.5<br>PPS:ab.3<br>Oxidation inhibitor:trace<br>Plasticizer:trace | 8.4 | 5.81 | 1.1 | Outer surface of magnetic powder satisfactorily coated, with almost no contact between particles. | 8.9 | ⊙ |
| Example 25 | Cylindrical | DO:20<br>Thickness:1.0<br>Length:10 | Magnetic powder 4:60<br>Magnetic powder 5:24<br>Magnetic powder 6:13<br>PPS:ab.1.5<br>Oxidation inhibitor:trace | 23.0 | 7.27 | 1.3 | Outer surface of magnetic powder satisfactorily coated, with almost no mutual contact between particles. | 8.2 | ○ |
| Example 26 | Cylindrical | DO:20<br>Thickness:1.0<br>Length:10 | Magnetic powder 4:60<br>Magnetic powder 5:24<br>Magnetic powder 6:13<br>Liquid crystal polymer:ab.1.5<br>Oxidation inhibitor:trace<br>Plasticizer:trace | 23.6 | 7.28 | 1.2 | Outer surface of magnetic powder satisfactorily coated, with almost no mutual contact between particles. | 8.3 | ○ |
| Comparative example 3 | Rod-shaped | DO:15<br>Length:10 | Magnetic powder 1:99 | Unmeasurable | Unmeas-urable | 12 | Coating of outer surface | 1.2 | x |

TABLE 4-continued

| | Shape of magnet | Size of magnet (mm) | Magnet composition (wt %) | Magnetic energy product (BH)max(MGOe) | Density ρ(g/cm$^3$) | Void ratio (%) | State of resin | Mechanical strength (kgf/cm$^2$) | Corrosion resistance |
|---|---|---|---|---|---|---|---|---|---|
| | | | Epoxy resin:1 | | | | of magnetic powder insufficient. | | |
| Comparative example 4 | Rod-shaped | DO:15 Length:10 | Magnetic powder 1:95 Epoxy resin:5 | Unmeasurable | — | 4 | Resin discharged onto outer surface of magnet. | 3.4 | Δ |
| Comparative example 5 | Rod-shaped | DO:15 Length:10 | Magnetic powder 1:99.1 Polyamide:0.9 | Unmeasurable | Unmeas-urable | — | Ignition caused by oxidation of magnetic powder | — | — |

DO:Outer Diameter

As shown in these Tables, it was confirmed that the rare earth bonded magnets of Examples 15 to 26 were excellent in shape, with a low void ratio and a high mechanical strength, and were excellent in magnetic properties and corrosion resistance.

In the rare earth bonded magnet of Comparative Example 3, in contrast, insufficient bonding between the magnet powder and the binding resin caused the magnet powder to come off under the effect of shock acting during measurement of magnetic properties, with a low corrosion resistance such that the magnet could not be used in practice.

In Comparative Example 4, there occurred an abnormality of discharge of resin onto the outer surface of the magnet.

In Comparative Example 5, it was difficult to knead the mixture and oxidation of the magnet powder was so violent as to cause ignition.

According to the present invention, as is clear from the results described above, it is possible to provide a rare earth bonded magnet which is excellent in moldability and corrosion resistance, has a high mechanical strength, and is excellent in magnetic properties, with a slight amount of resin.

What is claimed is:

1. A rare earth bonded magnet which contains a rare earth magnet powder, a thermoplastic resin and an oxidation inhibitor, wherein:

a content of said thermoplastic resin is within a range of from 1 to 3.8 wt. %;

said thermoplastic resin covers an outer surface of said rare earth magnet powder, and is present so as to prevent adjacent particles of rare earth magnet powder from coming into contact with each other;

said rare earth magnet powder is a mixture of two or more kinds of rare earth magnet powder having different chemical compositions or average particle diameters selected from the group consisting of:

a first composition comprising rare earth elements mainly including Sm and transition metals including Co;

a second composition comprising, R, transition metals mainly including Fe, and B wherein R represents at least one element selected from rare earth elements including Y; and a third composition comprising rare earth elements mainly including Sm, transition metals mainly including Fe, and interstitial elements mainly including N; and an amount of said oxidation inhibitor is within a range of from 0.1 to 2.0 wt. %.

2. A rare earth bonded magnet according to claim 1, wherein said bonded magnet includes a void ratio of no more than 2 vol. %.

3. A rare earth bonded magnet according to clam 1, wherein said thermoplastic resin has a melting point of no more than 400° C.

4. A rare earth bonded magnet according to claim 3, wherein said thermoplastic resin has a satisfactory wettability to said surface of said rare earth magnet powder.

5. A rare earth bonded magnet according to claim 1, wherein said thermoplastic resin is at least one polymer selected from a polyamide, a liquid crystal polymer, and polyphenylene sulfide.

6. A rare earth bonded magnet which contains a rare earth magnet powder, a thermoplastic resin and an oxidation inhibitor, wherein:

a content of said thermoplastic resin is within a range of from 1 to 3.8 wt. % and said oxidation inhibitor is an additive added to a composition of said rare earth magnet powder and said thermoplastic resin for preventing oxidation of said rare earth magnet powder and said thermoplastic resin;

said rare earth magnet powder is a mixture of two or more kinds of rare earth magnet powder having different chemical compositions or average particle diameters selected from the group consisting of:

a first composition comprising rare earth elements mainly including Sm and transition metals including Co;

a second composition comprising, R, transition metals mainly including Fe, and B wherein R represents at least one element selected from rare earth elements including Y; and a third composition comprising rare earth elements mainly including Sm, transition metals mainly including Fe, and interstitial elements mainly including N;

an amount of said oxidation inhibitor is within a range of from 0.1 to 2.0 wt. %.; and said bonded magnet includes a void ratio of no more than 2 vol. %.

7. A rare earth bonded magnet according to claim 6, wherein said thermoplastic resin has a melting point of no more than 400° C.

8. A rare earth bonded magnet according to claim 6, wherein said thermoplastic resin is at least one polymer selected from a polyamide, a liquid crystal polymer, and polyphenylene sulfide.

9. A composition for a rare earth bonded magnet for manufacturing a rare earth bonded magnet, which comprises a rare earth magnet powder, a thermoplastic resin and an oxidation inhibitor for preventing oxidation of said rare earth magnet powder and said thermoplastic resin, wherein:

said oxidation inhibitor is an additive added to a composition of said rare earth magnet powder and said thermoplastic resin; and the amount of said thermoplastic resin is within a range of from 1 to 3.8 wt. % and an amount of said oxidation inhibitor is within a range of from 0.1 to 2.0 wt. % such that, when said composition for a rare earth bonded magnet is extruded, a fluidity sufficient to permit extrusion in forming is ensured;

said rare earth magnet powder is a mixture of two or more kinds of rare earth magnet powder having different chemical compositions or average particle diameters selected from the group consisting of:

a first composition comprising rare earth elements mainly including Sm and transition metals including Co;

a second composition comprising, R, transition metals mainly including Fe, and B wherein R represents at least one element selected from rare earth elements including Y; and a third composition comprising rare earth elements mainly including Sm, transition metals mainly including Fe, and interstitial elements mainly including N.

10. A composition for a rare earth bonded magnet according to claim 9, wherein said oxidation inhibitor is a chelating agent which makes a surface of said magnet powder inactive.

11. A composition for a rare earth bonded magnet according to claim 9, wherein a total amount of said thermoplastic resin and said oxidation inhibitor is within a range of from 1.1 to 4.7 wt. %.

12. A composition for a rare earth bonded magnet according to claim 9, wherein said composition further contains a plasticizer or a lubricant.

13. A composition for a rare earth bonded magnet according to claim 9, wherein said composition for a rare earth bonded magnet is a kneaded mass formed by kneading said rare earth magnet powder, said thermoplastic resin, and said oxidation inhibitor at a temperature at which said thermoplastic resin melts or softens.

14. A composition for a rare earth bonded magnet for manufacturing a rare earth bonded magnet, which contains a rare earth magnet powder, a thermoplastic resin, and an oxidation inhibitor for preventing oxidation of said rare earth magnet powder and said thermoplastic resin, wherein:

said oxidation inhibitor is an additive added to a composition of said rare earth magnet powder and said thermoplastic resin; and the amount of said thermoplastic resin is within a range of from 1 to 3.8 wt. % and an amount of said oxidation inhibitor is within a range of from 0.1 to 2.0 wt. % such that, when said composition for a rare earth bonded magnet is extruded, a fluidity sufficient to permit extrusion in forming is ensured; and said rare earth magnet powder is a mixture of two or more kinds of rare earth magnet powder having different chemical compositions or average particle diameters selected from the group consisting of:

a first composition comprising rare earth elements mainly including Sm and transition metals including Co;

a second composition comprising, R, transition metals mainly including Fe, and B wherein R represents at least one element selected from rare earth elements including Y; and a third composition comprising rare earth elements mainly including Sm, transition metals mainly including Fe, and interstitial elements mainly including N.

15. A composition for a rare earth bonded magnet according to claim 14, wherein:

said thermoplastic resin is at least one polymer selected from a polyamide, a liquid crystal polymer and polyphenylene sulfide, and said oxidation inhibitor is a chelating agent which makes a surface of said magnet powder inactive.

16. A composition for a rare earth bonded magnet according to claim 15, wherein said composition for a rare earth bonded magnet is a kneaded mass formed by kneading said rare earth magnet powder, said thermoplastic resin, and said oxidation inhibitor at a temperature at which said thermoplastic resin melts or softens.

* * * * *